US005794471A

United States Patent [19]

Rizzo

[11] Patent Number: 5,794,471

[45] Date of Patent: Aug. 18, 1998

[54] HOLDER FOR KEY INCLUDING KEY TURNER

[76] Inventor: Frank Rizzo, 52 Hall St., Eastchester, N.Y. 10709

[21] Appl. No.: 681,056

[22] Filed: Jul. 22, 1996

[51] Int. Cl.[6] ..... A44B 15/00; E05B 19/04

[52] U.S. Cl. ..... 70/456 R; 70/408

[58] Field of Search ..... 70/456 R, 457, 70/458, 408; 16/307, 374; 81/177.2, 177.8, 177.5, 177.6, 177.7

[56] References Cited

U.S. PATENT DOCUMENTS

| | | | |
|---|---|---|---|
| 1,175,902 | 3/1916 | Peterson | 81/177.5 |
| 1,442,174 | 1/1923 | Oberjohann | 81/177.6 |
| 1,889,471 | 11/1932 | Glaenzer | 70/456 R |
| 2,596,716 | 5/1952 | Otten | 70/456 R |
| 2,625,814 | 1/1953 | Mullan | 70/456 R |
| 3,267,534 | 8/1966 | Dansereau | 70/456 R |
| 3,277,680 | 10/1966 | Merila | 70/456 R |
| 3,526,112 | 9/1970 | Herrington . | |
| 3,606,777 | 9/1971 | Watson . | |
| 3,863,693 | 2/1975 | Carriker | 81/177.6 |
| 4,000,767 | 1/1977 | Geng | 81/177.2 |
| 4,583,383 | 4/1986 | Bosco et al. | 70/458 |
| 4,909,054 | 3/1990 | Fox . | |
| 4,910,983 | 3/1990 | Taylor | 70/456 R |
| 5,207,082 | 5/1993 | LeMaitre | 70/408 |
| 5,440,910 | 8/1995 | Florian . | |
| 5,487,291 | 1/1996 | Voigt . | |

FOREIGN PATENT DOCUMENTS

| | | | |
|---|---|---|---|
| 82346 | 6/1983 | European Pat. Off. | 70/395 |

*Primary Examiner*—Steven N. Meyers
*Assistant Examiner*—Tuyet-Phuong Pham
*Attorney, Agent, or Firm*—Pennie & Edmonds LLP

[57] ABSTRACT

A keyholder and turner haw a body in which a key is held for turning in a lock. The holder has deployable wings and a chain for holding additional keys. The key is held in a central compartment of the holder by the urging of a key stop projection. The projection assists in holding the key head during operation.

1 Claim, 3 Drawing Sheets

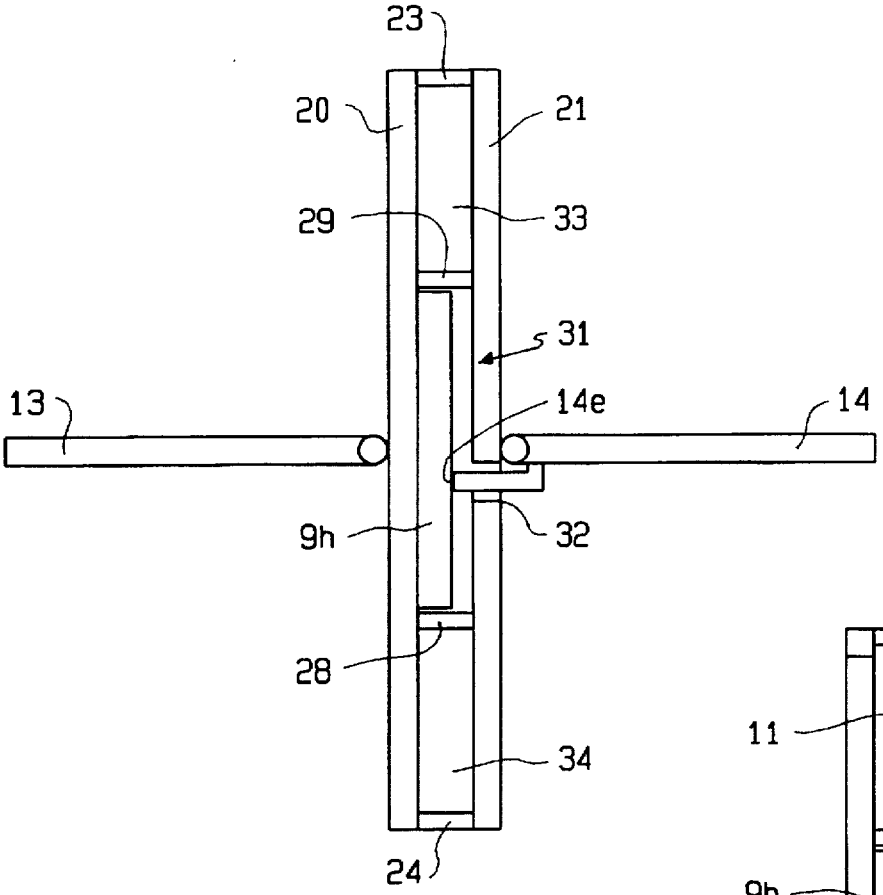
FIG.2
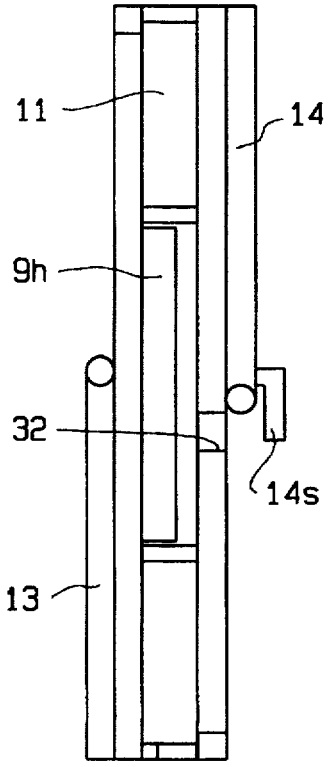
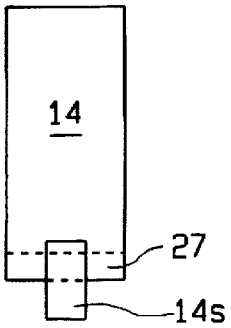
FIG.3a
FIG.3

HOLDER FOR KEY INCLUDING KEY TURNER

BACKGROUND OF THE INVENTION

Prior key holders have included key turning functions through increased mechanical advantage including removable turning elements (U.S. Pat. No. 5,207,082); and elements turnable for storage (U.S. Pat. No. 3,526,112). None of the prior key holders provide the key holding, key turning and compactness of the present invention.

SUMMARY OF THE INVENTION

Broadly, the present invention comprises a holder for keys and key turner which has handle wings deployable for turning and foldable when not in use for compactness.

The inventive holder includes an elongated body section having end light holding compartment and a central key holding compartment. The holder further includes deployable hinged gripping wings which wings when deployed provide together with the body section four (4) grippable and turnable handles for easy turning of a key mounted in central key holding compartment.

BRIEF DESCRIPTION OF THE DRAWINGS

FIG. 2 is a plan view of the key holder including the holder the body with handle wings deployed;

FIG. 3 is a plan view of the key holder with the handle wings folded against holder body;

FIG. 3*a* is an elevational view of a handle wing including key stop projection.

DESCRIPTION OF THE PREFERRED EMBODIMENT

Figure 1:
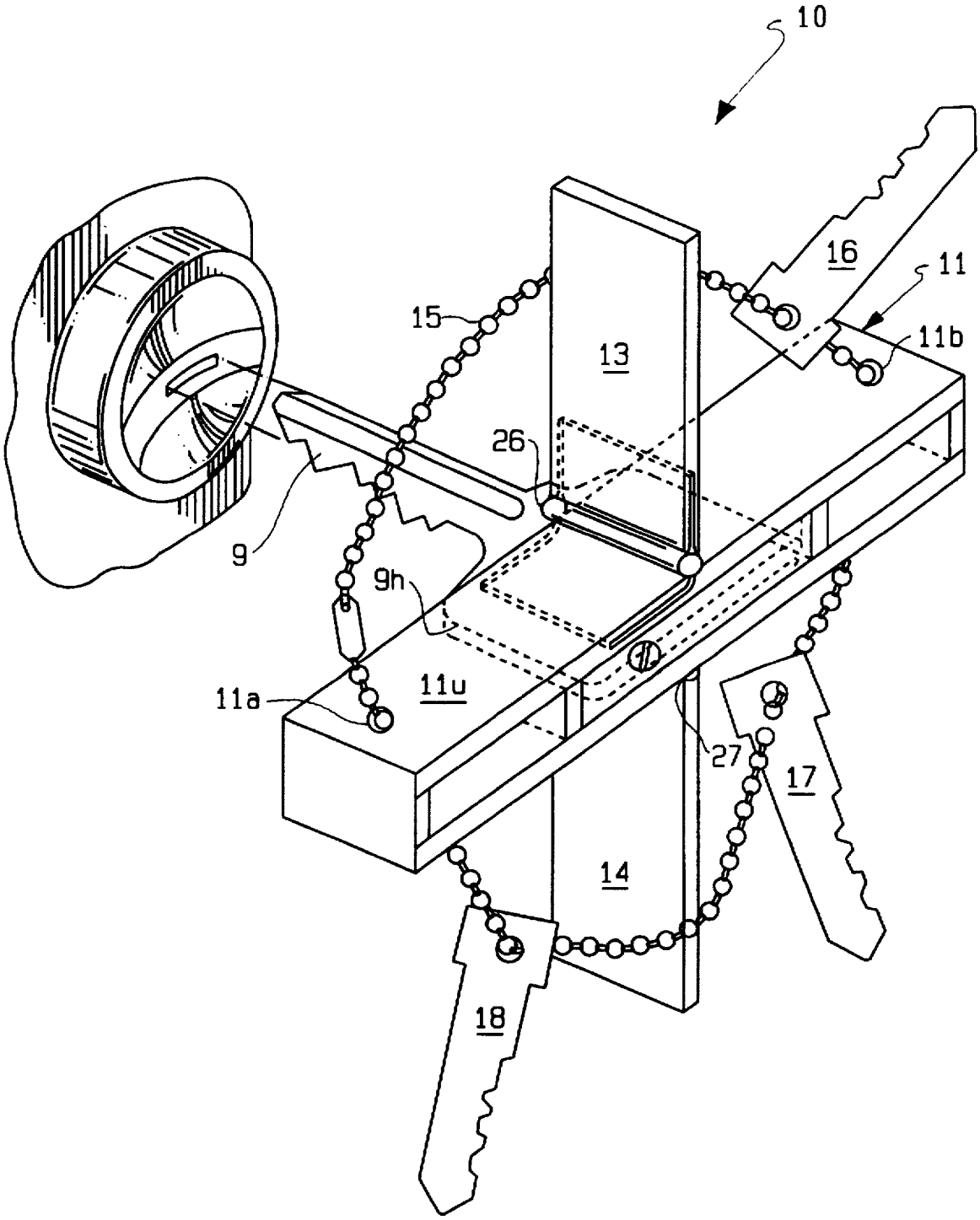
FIG. 1 is a perspective view of the inventive key holder and turner positioned to be inserted in an automobile ignition lock.

In the Figures, key holder 10 includes elongated body 11, hinged handle wings 13, 14 and flexible key chain 15 passing through holes 11*a* and 11*b* in the ends of body 11. Keys 16, 17 and 18 hang on chain 15. Wing 13 is attached to body side 11*u* through hinge 26 and wing 14 is attached to body side 111 through hinge 27. Body 11 includes center key holding compartment section 31 for housing key 9 which is used in a lock which required a significant torque to turn, i. e., an automobile ignition lock.

Turning to FIG. 2, body 11 also includes end compartments 33, 34 which house small flashlights or other appliances. Compartments 31, 33 and 34 are formed by body side pieces 20, 21; two end pieces 23, 24 positioned between side pieces 20, 21 and two interior spacer pieces 28, 29 between the side pieces. Central open compartment 31 is defined by side pieces 20, 21 and spacer pieces 28, 29. Key head 9*h* is held in central compartment 31 by the urging of wing key stop projection 14*s*. When wing 14 is pivoted from its closed position (FIG. 3) to its open position wing projection 14*s* passes through opening 32 in side piece 21 until projection end 14*e* abuts key head 9*h*. Projection 14*s* assists in holding key head 9*h* during operation.

Figure 4A:
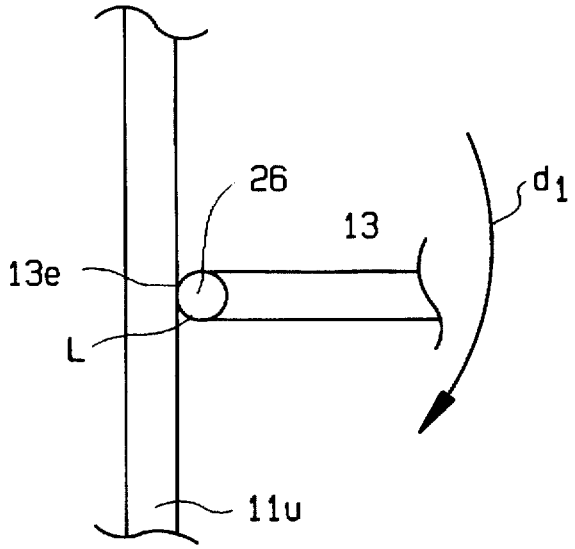
FIG. 4*a* is a partial plan view showing the spring-loaded hinge arrangement of one of the handle wings deployed from the holder body.
Figure 4B:
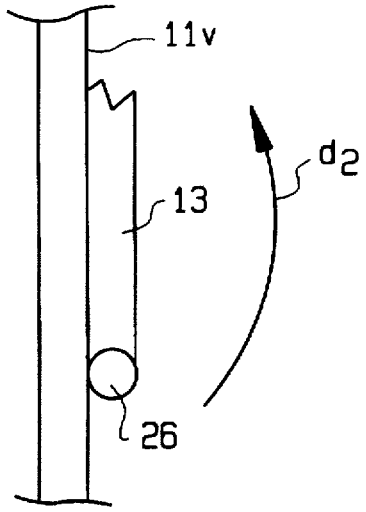
FIG. 4*b* is a view similar to FIG. 4*a* with the handle wing foldable against the holder body.
Figure 5:
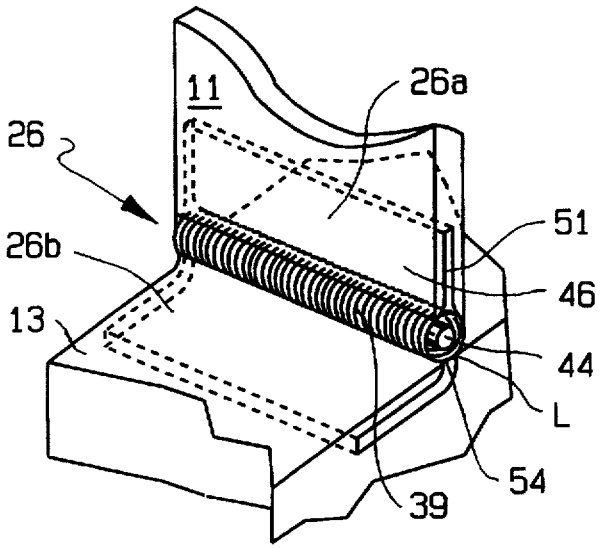
FIG. 5 is a perspective view showing a hinge, its mounting and the hinge spring.

Turning to FIG. 4*a*, the turning of wing 13 in direction ($d_1$) is limited by the hinge limit mechanism 13*e* in hinge 26 which limits wing 13 movement to positions which facilitate gripping for turning and preferably such movement limit occurs when the wing is at or about 90° to body 11. Movement of wing 13 in direction $d_2$ is limited by body side 11*u*. FIG. 4*b* shows wing 13 swung in direction ($d_2$) to its closed position. Turning to FIG. 5, wing 13 has hinge 26 which includes central coil spring tubular part 39 secured to the body 11 through base 26*a* and secured to wing 13 through base 26*b*. Hinge pin 44 passes through aligned tubular spring 39. Spring hinge 26 is constructed so that wing 13 is biased to the closed position. Spring hinge 27 is similarly constructed.

I claim:

1. A key holder and turner unit comprising (a) an elongated body section having two sides;

(b) lock key holding compartment means in said body section;

(c) at least one hinged wing swingable about a hinge in a direction away from a section side to a position in which the wing is projecting from such side;

(d) limit means for preventing turning of said at least one hinged wing in said direction beyond a position suitable for gripping the wing together with the body; and (e) at least one hinged wing having in addition projection means and having a key in the lock key holding compartment which projection means engages such key and holds such key in the compartment when said hinged wing is open whereby the body section and at least one hinged wing are grippable for turning in such direction when the key is in the lock key holding compartment inserted in a lock and turned.

* * * * *